US011713762B2

(12) United States Patent
Tatsuwaki et al.

(10) Patent No.: US 11,713,762 B2
(45) Date of Patent: Aug. 1, 2023

(54) SCROLL COMPRESSOR

(71) Applicant: Mitsubishi Electric Corporation, Tokyo (JP)

(72) Inventors: Kohei Tatsuwaki, Tokyo (JP); Fumihiko Ishizono, Tokyo (JP); Yuji Takamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 167 days.

(21) Appl. No.: 17/297,550

(22) PCT Filed: Jan. 28, 2019

(86) PCT No.: PCT/JP2019/002689
§ 371 (c)(1),
(2) Date: May 27, 2021

(87) PCT Pub. No.: WO2020/157792
PCT Pub. Date: Aug. 6, 2020

(65) Prior Publication Data

US 2022/0010797 A1 Jan. 13, 2022

(51) Int. Cl.
*F04C 23/00* (2006.01)
*F04C 18/02* (2006.01)
*F04C 29/02* (2006.01)

(52) U.S. Cl.
CPC ..... *F04C 29/02* (2013.01); *F04C 18/0215* (2013.01); *F04C 18/0246* (2013.01);
(Continued)

(58) Field of Classification Search
CPC .... F04C 29/02; F04C 29/023; F04C 18/0215; F04C 18/0246; F04C 23/008
See application file for complete search history.

(56) References Cited

U.S. PATENT DOCUMENTS 4,696,630 A * 9/1987 Sakata ..... F04C 29/0021 418/94
2005/0053508 A1* 3/2005 Morozumi ..... F04C 18/0215 418/55.6
(Continued)

FOREIGN PATENT DOCUMENTS

JP S63-087287 U 6/1988
JP 2010-174902 A 8/2010
(Continued)

OTHER PUBLICATIONS

Office Action dated Feb. 1, 2022 issued in corresponding JP patent application No. 2020-568883 (and English translation).
(Continued)

*Primary Examiner* — Deming Wan
(74) *Attorney, Agent, or Firm* — Posz Law Group, PLC

(57) ABSTRACT

A scroll compressor includes: a shell forming an outer case, a fixed scroll and an orbiting scroll stored in the shell, a frame holding the orbiting scroll, a thrust plate between the orbiting scroll and the frame, and a thrust oil return pipe fixed to the frame. The shell forms an oil reservoir in which lubricating oil is reserved. The orbiting scroll and fixed scroll form a compression chamber. Lubricating oil flows through the thrust oil return pipe to return to the oil reservoir. A hole portion on the thrust plate passes from a first surface portion that slidably contacts the orbiting scroll to a second surface portion facing the frame. The thrust oil return pipe is inserted into the hole portion and fits in the thrust plate. An upper end portion of the thrust oil return pipe does not protrude from the first surface portion of the thrust plate

6 Claims, 7 Drawing Sheets

(52) U.S. Cl.
CPC ..... *F04C 29/023* (2013.01); *F04C 2210/14* (2013.01); *F04C 2210/206* (2013.01); *F04C 2240/30* (2013.01); *F04C 2240/60* (2013.01)

(56) References Cited

U.S. PATENT DOCUMENTS

| | | | | |
|---|---|---|---|---|
| 2005/0069443 | A1* | 3/2005 | Uekawa | F04C 29/028 418/55.3 |
| 2009/0202376 | A1* | 8/2009 | Takei | F04C 29/0021 418/55.1 |
| 2016/0348676 | A1 | 12/2016 | Ogata et al. | |
| 2019/0195224 | A1 | 6/2019 | Matsui et al. | |

FOREIGN PATENT DOCUMENTS

| | | | |
|---|---|---|---|
| JP | 2013-204488 | A | 10/2013 |
| JP | 2014-173525 | A | 9/2014 |
| JP | 2015-209767 | A | 11/2015 |
| WO | 2017/169596 | A1 | 10/2017 |

OTHER PUBLICATIONS

International Search Report of the International Searching Authority dated Apr. 23, 2019 for the corresponding International application No. PCT/JP2019/002689 (and English translation).
Examination Report dated May 11, 2022 issued in corresponding GB Patent Application No. 2109442.0.
Office Action dated Jul. 29, 2022 issued in corresponding CN Patent Application No. 201980089972.3 (and English translation).

* cited by examiner

Comparative Example

Comparative Example

SCROLL COMPRESSOR

CROSS REFERENCE TO RELATED APPLICATION

This application is a U.S. national stage application of PCT/JP2019/002689 filed on Jan. 28, 2019, the contents of which are incorporated herein by reference.

TECHNICAL FIELD

The present disclosure relates to a scroll compressor to be used in a refrigeration cycle for refrigeration, air conditioning or other uses.

BACKGROUND ART

A scroll compressor in the related art includes a frame slidably holding an orbiting scroll, a fixed scroll forming a compression chamber together with the orbiting scroll, and a shell storing the frame and the fixed scroll (see Patent Literature 1, for example). In the scroll compressor in Patent literature 1, void portions are formed on the fixed scroll and the frame, and a positioning pin is inserted into the void portions. By the positioning pin, the frame and the fixed scroll are coupled. In the scroll compressor in Patent Literature 1, when a thrust plate is disposed between the frame and the orbiting scroll, the self-rotation of the thrust plate can be prevented by the positioning pin coupling the fixed scroll and the frame.

CITATION LIST

Patent Literature

Patent Literature 1: Japanese Unexamined Patent Application Publication No. 2015-209767

SUMMARY OF INVENTION

Technical Problem

However, in the scroll compressor in Patent Literature 1, it is necessary to avoid the interference between the positioning pin coupling the fixed scroll and the frame and the orbiting scroll, and it is not possible to adopt a large-size orbiting scroll. Therefore, in the scroll compressor in Patent Literature 1, the scroll capacity to determine the utmost performance of the compressor is limited.

The present disclosure has been made to solve the above problem, and provides a scroll compressor that makes it possible to adopt a large-size orbiting scroll and enhance the utmost performance of the compressor while preventing the self-rotation of the thrust plate.

Solution to Problem

A scroll compressor according to an embodiment of the present disclosure includes: a shell forming an outer case, the shell forming an oil reservoir in which lubricating oil is reserved: a fixed scroll stored in the shell; an orbiting scroll stored in the shell, the orbiting scroll forming a compression chamber together with the fixed scroll; a frame holding the orbiting scroll; a thrust plate disposed between the orbiting scroll and the frame; and a thrust oil return pipe fixed to the frame, the thrust oil return pipe being a pipe through which the lubricating oil flows to return to the oil reservoir, wherein: a hole portion is formed on the thrust plate, the hole portion passing from a first surface portion to a second surface portion, the first surface portion slidably contacting with the orbiting scroll, the second surface portion facing the frame; and the thrust oil return pipe is inserted into the hole portion and is fit in the thrust plate, and an upper end portion of the thrust oil return pipe does not protrude from the first surface portion of the thrust plate.

Advantageous Effects of Invention

In the scroll compressor according to an embodiment of the present disclosure, the thrust oil return pipe is inserted into the hole portion and is fit in the thrust plate, and the upper end portion of the thrust oil return pipe does not protrude from the first surface portion of the thrust plate. Therefore, the scroll compressor according to an embodiment of the present disclosure makes it possible to prevent the self-rotation of the thrust plate, even when there is no positioning pin coupling the fixed scroll and the frame. Further, since there is no positioning pin coupling the fixed scroll and the frame, the scroll compressor according to an embodiment of the present disclosure makes it possible to adopt a large-size orbiting scroll and enhance the utmost performance of the compressor.

DESCRIPTION OF EMBODIMENTS

Figure 1:
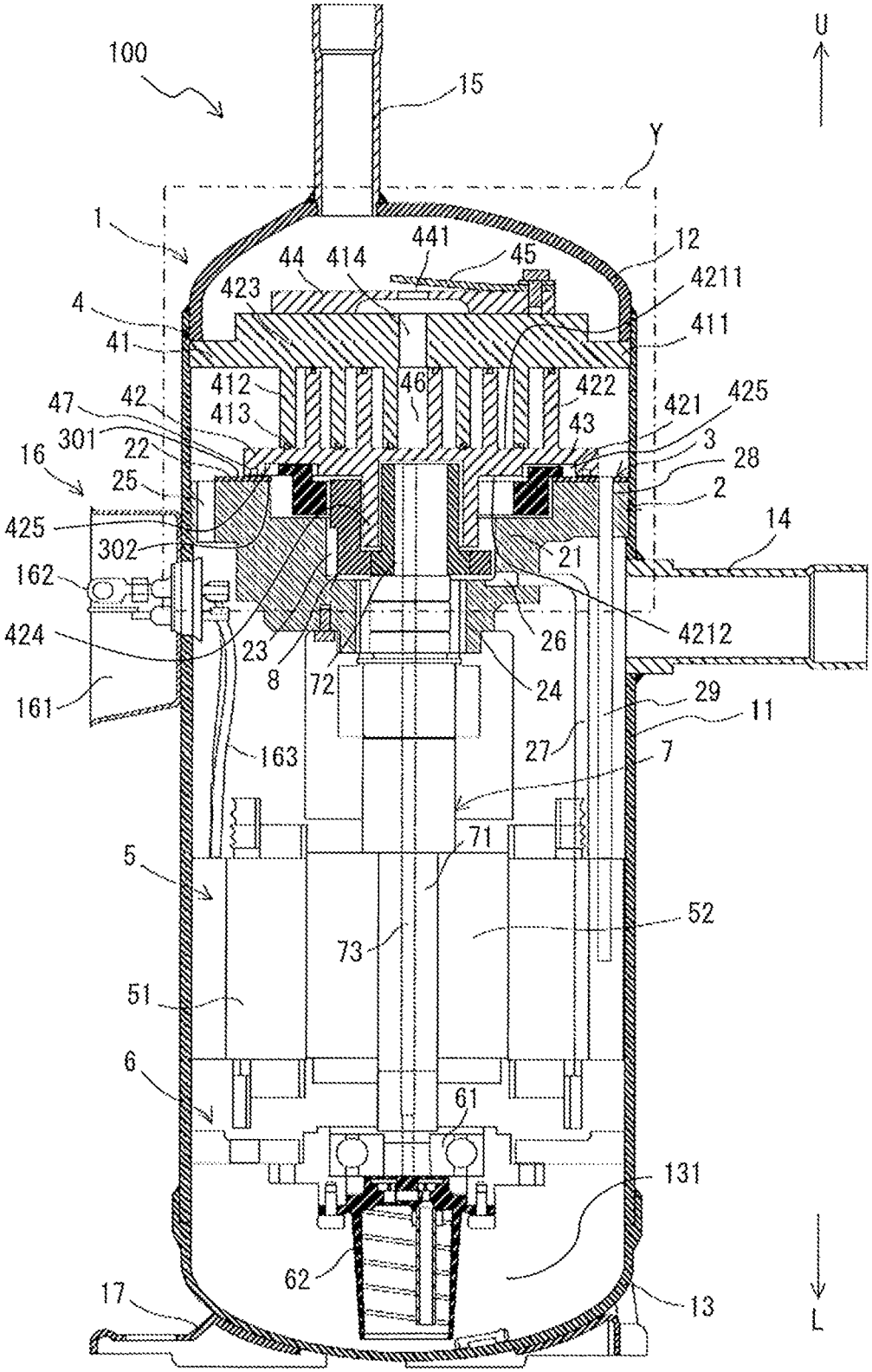
FIG. 1 is a longitudinal sectional view of a scroll compressor according to Embodiment 1 of the present disclosure.

A scroll compressor 100 according to an embodiment of the present disclosure will be described below with reference to the drawings. Components denoted by identical reference characters in the drawings are identical or corresponding components, and are common in all of the embodiments described below. Further, forms of components shown in all of the specification are just examples, and the configuration is not limited to the forms described in the specification. In addition, the relation of sizes of parts in the drawings may differ from that of actual ones. Further, for facilitating understanding, terms (for example, "upward", "downward", "right", "left", "front" and "rear") indicating directions are used as necessary. These words are merely words for convenience of descriptions, and dispositions and orientations of devices and components are not limited.

Embodiment 1

[Configuration of Scroll Compressor 100]

FIG. 1 is a longitudinal sectional view of the scroll compressor 100 according to Embodiment 1 of the present disclosure. The scroll compressor 100 is applied to a refrigeration cycle device to be used for refrigeration or air conditioning, as exemplified by a refrigerator, a freezer, a vending machine, an air-conditioning device, a freezer or a water heater. The scroll compressor 100 suctions and compresses refrigerant circulating through a refrigeration circuit of the refrigeration cycle device, and discharges the refrigerant having a high temperature and a high pressure.

The scroll compressor 100 includes a shell 1, a main frame 2, a thrust plate 3, a compression mechanism unit 4 and thrust oil return pipes 29. In addition, the scroll compressor 100 includes a drive mechanism unit 5, a sub frame 6, a crankshaft 7 and a bush 8. The scroll compressor 100 according to Embodiment 1 is what is called a vertical compressor to be used such that the central axis of the crankshaft 7 is nearly perpendicular relative to the ground. In the following description, an arrow side in the upward direction in the figure is referred to as one end side U as an upper side, and an arrow side in the downward direction in the figure is referred to as the other end side L as a lower side.

(Shell 1)

The shell 1 constitutes an outer case of the scroll compressor 100. The shell 1 is a tubular housing composed of a conductive material such as metal and having both ends closed, and includes a main shell 11, an upper shell 12, a lower shell 13, a suction pipe 14, a discharge pipe 15, an electric supply unit 16 and a fixed base 17. A fixed scroll 41 and the main frame 2 are fixed to an inner wall of the shell 1. Further, an oil reservoir 131 in which lubricating oil is reserved is formed at a lower portion of the interior of the shell 1.

The main shell 11 is a cylindrical pipe, and forms a cylindrical circumferential wall. The upper shell 12 is a nearly hemispherical lid body, and a part of the upper shell 12 is connected to the main shell 11 on the one end side U by welding or other methods, and closes one opening port of the main shell 11. The lower shell 13 is a nearly hemispherical bottom body, and a part of the lower shell 13 is connected to the main shell 11 on the other end side L by welding or other methods, and closes the other opening port of the main shell 11. The lower shell 13 forms the oil reservoir 131 in which the lubricating oil is reserved. The lubricating oil is supplied to a lubricated portion such as a bearing portion in the scroll compressor 100.

The suction pipe 14 is a pipe through which the refrigerant is introduced into the interior of the shell 1. The suction pipe 14 is connected to the main shell 11 by brazing or other methods, in a state where a part of the suction pipe 14 is inserted into a hole formed on a sidewall of the main shell 11 such that the suction pipe 14 communicates with the internal space of the shell 1.

The discharge pipe 15 is a pipe through which the refrigerant compressed by the compression mechanism unit 4 is discharged to the exterior of the shell 1. The discharge pipe 15 is connected to the upper shell 12 by brazing or other methods, in a state where a part of the discharge pipe 15 is inserted into a hole formed at an upper portion of the upper shell 12 such that the discharge pipe 15 communicates with the internal space of the shell 1. The discharge pipe 15 connects the internal space of the shell 1 and the refrigeration circuit in the exterior of the shell 1.

The electric supply unit 16 is a unit to be used for the electric supply of the scroll compressor 100, and is provided on an outer wall of the main shell 11. The electric supply unit 16 includes a cover 161, an electric supply terminal 162 and a wire 163. The cover 161 is a cover member. The electric supply terminal 162 is a metal member. One end of the electric supply terminal 162 is provided while being surrounded by the cover 161, and the other end is provided in the interior of the main shell 11. One end of the wire 163 is connected to the electric supply terminal 162, and the other end is connected to a stator 51 of the drive mechanism unit 5 described later.

The fixed base 17 is a support base supporting the shell 1. The fixed base 17 includes a plurality of leg portions each of which a screw hole is formed, and by screw fixation of the leg portion, the scroll compressor 100 can be fixed to another member such as a housing of an air-conditioning outdoor unit.

(Main Frame 2)

Figure 2:
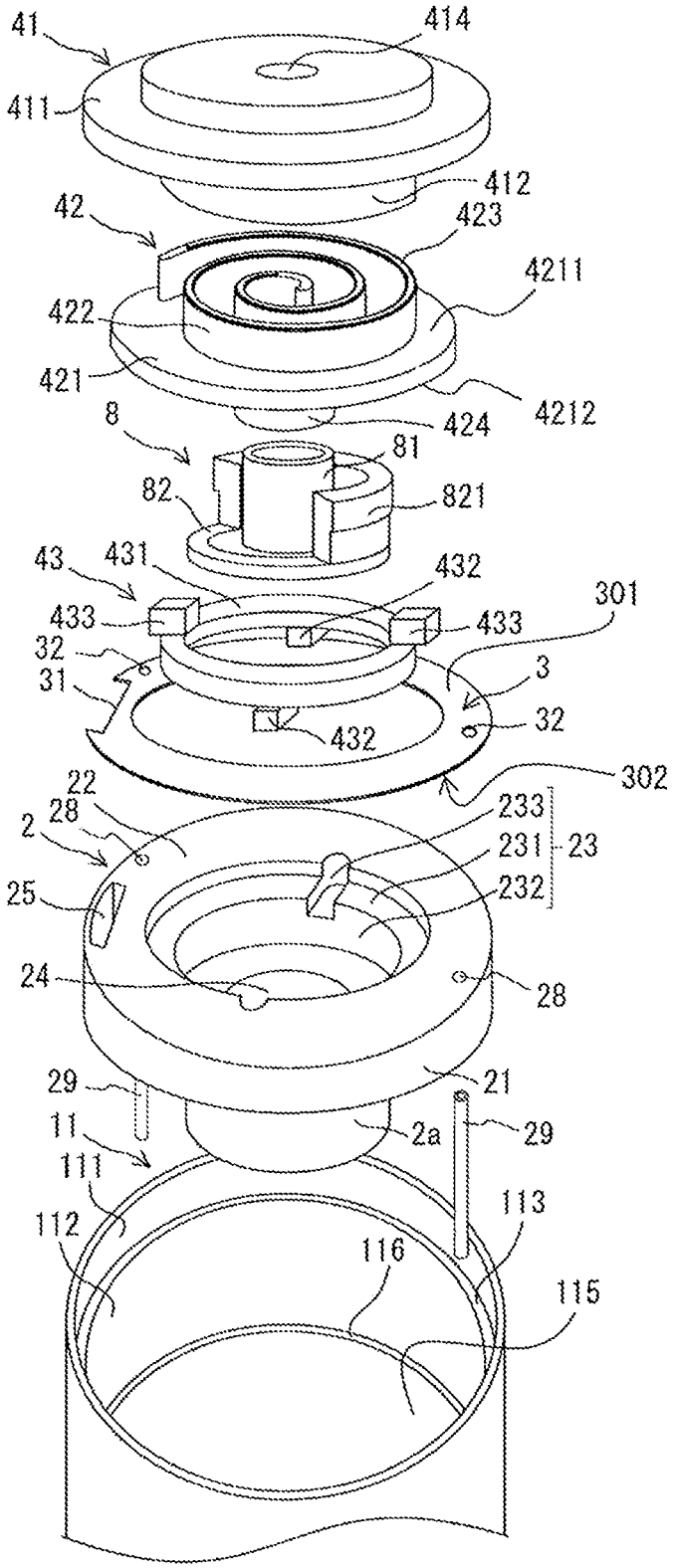
FIG. 2 is an exploded perspective view of a partial configuration of the scroll compressor according to Embodiment 1 of the present disclosure.

FIG. 2 is an exploded perspective view of a partial configuration of the scroll compressor 100 according to Embodiment 1 of the present disclosure. The main frame 2 will be described with reference to FIG. 1 and FIG. 2. The main frame 2 is one of the frames of the scroll compressor 100. An outer circumferential edge portion of the main frame 2 is fixed to an inner circumferential wall of the main shell 11. The main frame 2 is a cylindrical metal frame. The main frame 2 is provided in the interior of the shell 1, and holds an orbiting scroll 42 of the compression mechanism unit 4 described later such that the orbiting scroll 42 can orbit. The main frame 2 includes a body portion 21 and an oil return pipe 27. Further, a flat surface 22, a storage portion 23, a shaft hole 24, a suction port 25, an oil return hole 26 and thrust oil return holes 28 are formed on the body portion 21 of the main frame 2.

The body portion 21 is a principal portion forming the main frame 2. For example, the body portion 21 is supported by being secured to an inner circumferential surface of the main shell 11 on the one end side U by shrink fitting, welding or other methods. The body portion 21 is formed in a tubular shape. An outer circumferential portion of the body portion 21 is fixed to the shell 1, and in an inner circumferential portion of the body portion 21, a part of the compression mechanism unit 4 is stored. The flat surface 22 is a wall surface of the body portion 21 on the one end side U, and is circularly formed. The thrust plate 3 described later is placed on the flat surface 22. The storage portion 23 is formed on the inner circumference side of the circularly formed flat surface 22.

The storage portion 23 is a concave portion formed at the radial center of the main frame 2 along the longitudinal direction of the shell 1, that is, along the axis direction of the crankshaft 7. In the storage portion 23, the one end side U is opened, and the interior is formed in a stepped shape in which the space is narrowed step by step in the direction of the other end side L. As shown in FIG. 2, an Oldham storage portion 231, a bush storage portion 232 and first Oldham grooves 233 are formed in the storage portion 23.

The Oldham storage portion 231 is formed at a part of a step portion on the other end side L of the flat surface 22 of the main frame 2. The Oldham storage portion 231 is formed on the one end side U of the storage portion 23. The bush storage portion 232 is formed on the other end side L of the storage portion 23, and communicates with the Oldham storage portion 231. The first Oldham grooves 233 are formed on the Oldham storage portion 231. Each first Oldham groove 233 is an Oldham groove formed on the main frame 2. Each first Oldham groove 233 is formed such that the outer end intrudes into a part of the inner circumference of the flat surface 22. The first Oldham grooves 233 are formed as a pair, and the first Oldham grooves 233 are formed to be arrayed along a nearly straight line across the axis of the crankshaft 7. Each first Oldham groove 233 is a key groove formed at a part of the body portion 21 and a part of the flat surface 22, and communicates with the Oldham storage portion 231.

The shaft hole 24 is formed on the other end side L of the storage portion 23, and communicates with the bush storage portion 232. That is, in the body portion 21, the storage portion 23 and the shaft hole 24 form a space passing through the main frame 2 in the vertical direction and widened step by step in the direction of the one end side U. A portion of the main frame 2 where the shaft hole 24 is formed supports the crankshaft 7 as a main bearing portion 2*a*. That is, the main bearing portion 2*a* constitutes the other end side L of the body portion 21, and in the interior, the shaft hole 24 is formed.

The suction port 25 is a hole through which the refrigerant is supplied to the compression mechanism unit 4, and is formed on an outer edge side of the flat surface 22 of the main frame 2 such that the suction port 25 passes through the body portion 21 in the vertical direction. The oil return hole 26 is formed on the other end side L of the main frame 2, and communicates with the bush storage portion 232. The oil return pipe 27 is inserted into the oil return hole 26. Through the oil return pipe 27, the lubricating oil reserved in the storage portion 23 is returned to the oil reservoir 131 in the lower shell 13. The number of suction ports 25 and the number of oil return holes 26 are not limited to one, and may be two or more. The number of the oil return pipes 27 is not limited to one, and may be two or more.

The thrust oil return holes 28 pass through the body portion 21 in the vertical direction as shown in FIG. 1, and opening ports of the thrust oil return holes 28 are formed on the flat surface 22 as shown in FIG. 2. The thrust oil return holes 28 are formed at two or more spots on the body portion 21. The thrust oil return holes 28 communicate with hole portions 32 formed on the thrust plate 3 described later. Further, the thrust oil return pipes 29 described later are inserted into the thrust oil return holes 28. The thrust oil return pipes 29 inserted into the thrust oil return holes 28 are fixed to the main frame 2.

(Thrust Plate 3)

Figure 3:
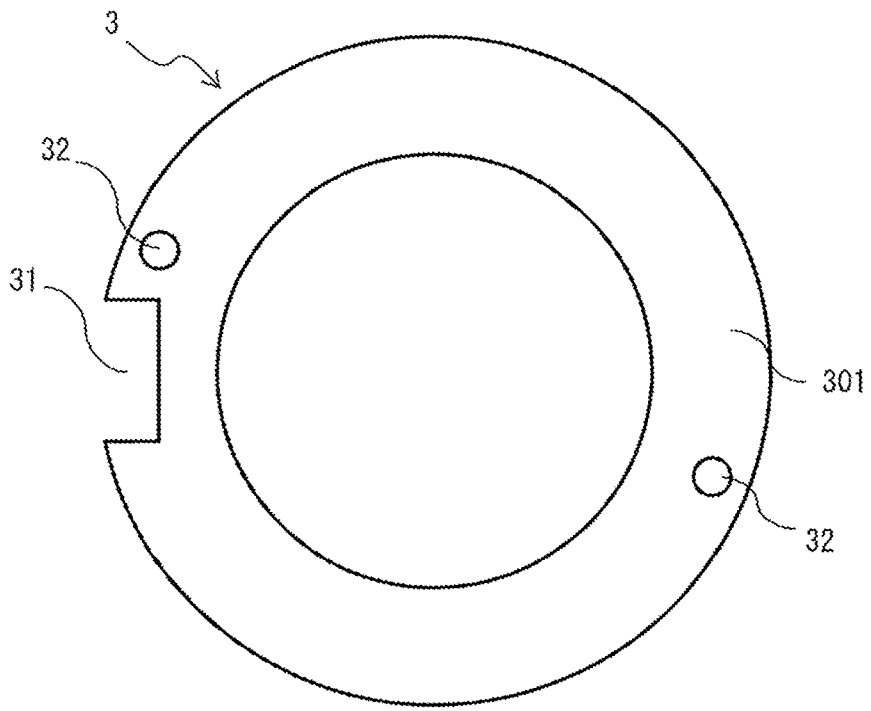
FIG. 3 is a top view of a thrust plate to be used in the scroll compressor according to Embodiment 1 of the present disclosure.

FIG. 3 is a top view of the thrust plate 3 to be used in the scroll compressor 100 according to Embodiment 1 of the present disclosure. The thrust plate 3 will be described with use of FIG. 1 to FIG. 3. As shown in FIG. 1, the thrust plate 3 is disposed between the orbiting scroll 42 and the main frame 2. The thrust plate 3 is a thin metal plate composed of steel, and functions as a thrust bearing. The thrust plate 3 is placed on the flat surface 22 of the main frame 2, and supports thrust load of the compression mechanism unit 4. As shown in FIG. 3, the thrust plate 3 is formed in a ring shape. A cutout portion 31 and the hole portions 32 are formed on the thrust plate 3.

The cutout portion 31 is a portion where a part of an outer edge of the ring-shaped thrust plate 3 is cut out, and is formed such that it corresponds to the suction port 25 of the main frame 2 and communicates with the suction port 25. For avoiding the overlap with the suction port 25, the cutout portion 31 has the same shape as the suction port 25 or has a larger shape than the suction port 25. The hole portions 32 pass from a first surface portion 301 to a second surface portion 302. The first surface portion 301 slidably contacts with the orbiting scroll 42. The second surface portion 302 faces the main frame 2. The hole portions 32 are formed at two or more spots on the thrust plate 3. As described above, the hole portions 32 communicate with the thrust oil return holes 28 formed on the main frame 2. Further, in the hole portions 32, the thrust oil return pipes 29 are inserted, and upper end portions 29*a* of the thrust oil return pipes 29 described later are disposed.

(Compression Mechanism Unit 4)

The compression mechanism unit 4 is a mechanism to compress the refrigerant. As shown in FIG. 1, the compression mechanism unit 4 includes the fixed scroll 41, the orbiting scroll 42, an Oldham ring 43, a chamber 44 and a discharge valve 45. By combining the fixed scroll 41 and the orbiting scroll 42, the compression mechanism unit 4 constitutes a compression chamber 46 in which the refrigerant is compressed.

The fixed scroll 41 forms the compression chamber 46 together with the orbiting scroll 42, and compresses fluid such as the refrigerant. As described in FIG. 1, the fixed scroll 41 is stored in the shell 1. An outer circumferential edge portion of the fixed scroll 41 is fixed to the inner circumferential wall of the main shell 11. The fixed scroll 41 faces the orbiting scroll 42, and faces the main frame 2 across the thrust plate 3. The fixed scroll 41 is composed of a metal such as cast iron, and includes a first baseplate 411, a first scroll body 412 and a tip seal 413.

The first baseplate 411 is a basal plate having a disc shape. The first scroll body 412 is a scroll lap protruding from a surface of the first baseplate 411 on the other end side L. The tip seal 413 is composed of rigid plastic, for example, and is disposed in a groove formed at a distal end of the first scroll body 412. The tip seal 413 restrains the leakage of the refrigerant, and holds the airtightness of the compression chamber 46. On the first baseplate 411 of the fixed scroll 41, a discharge port 414 is formed. The refrigerant compressed in the compression chamber 46 is discharged through the discharge port 414. The discharge port 414 is a through-hole formed at a nearly central portion of the first baseplate 411 in the vertical direction, which is the thickness direction of the first baseplate 411.

The orbiting scroll 42 forms the compression chamber 46 together with the fixed scroll 41, and compresses fluid such as the refrigerant. As shown in FIG. 1, the orbiting scroll 42 is stored in the shell 1. The orbiting scroll 42 is composed of a metal such as aluminum, and includes a second baseplate 421, a second scroll body 422, a tip seal 423 and a tubular portion 424. On the second baseplate 421 of the orbiting scroll 42, second Oldham grooves 425 are formed. A part of the Oldham ring 43 is stored in the second Oldham grooves 425. Each second Oldham groove 425 is an Oldham groove formed on the orbiting scroll 42. The second baseplate 421 is a basal plate having a disc shape. In the second baseplate 421, the second scroll body 422 is formed on an upper surface 4211, and on the other hand, a lower surface 4212 faces the first surface portion 301 of the thrust plate 3.

The second scroll body 422 is a scroll lap protruding from the upper surface 4211 of the second baseplate 421 on the one end side U. The tip seal 423 is composed of rigid plastic, for example, and is disposed in a groove formed at a distal end of the second scroll body 422. The tip seal 423 restrains the leakage of the refrigerant, and holds the airtightness of the compression chamber 46. The tubular portion 424 is a boss protruding from a nearly central portion of the lower surface 4212 of the second baseplate 421 on the other end side L and formed in a cylindrical shape. An orbiting bearing supporting a slider 81 described later in a rotatable manner, what is called a journal bearing is provided on an inner circumferential surface of the tubular portion 424. The tubular portion 424 is disposed in the shell 1 such that the central axis of the orbiting bearing is parallel to the central axis of the crankshaft 7. Therefore, the orbiting scroll 42 is eccentrically disposed relative to the fixed scroll 41.

Each second Oldham groove 425 is a key groove formed on a surface of the second baseplate 421 on the other end side L and having an oblong shape. The second Oldham grooves 425 are formed as a pair such that the second Oldham grooves 425 face each other across the tubular portion 424. The second Oldham grooves 425 are formed such that a line joining the second Oldham grooves 425 is orthogonal to a line joining the first Oldham grooves 233.

Figure 4:
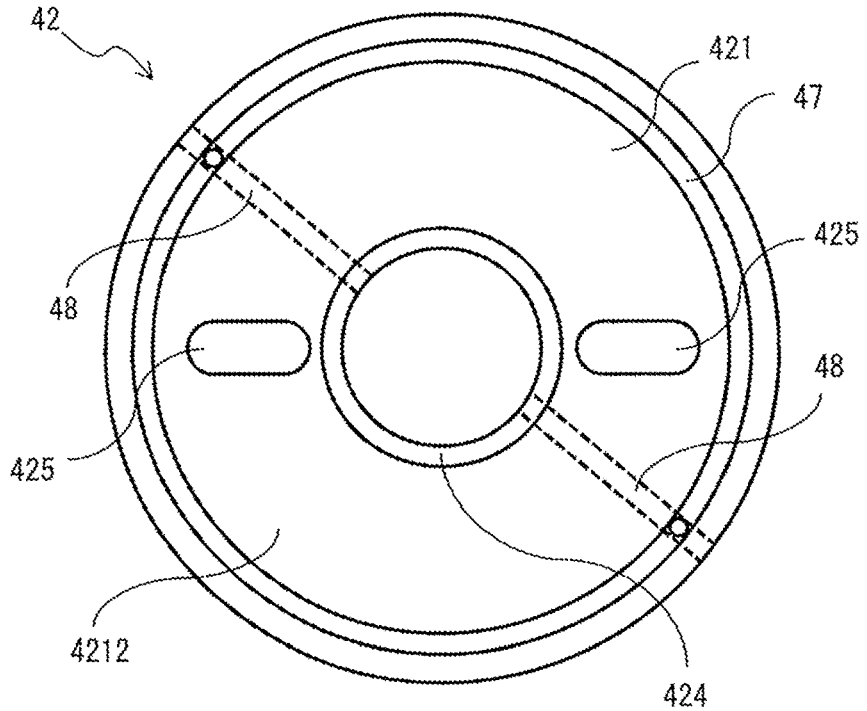
FIG. 4 is a bottom view of an orbiting scroll to be used in the scroll compressor according to Embodiment 1 of the present disclosure.
Figure 5:
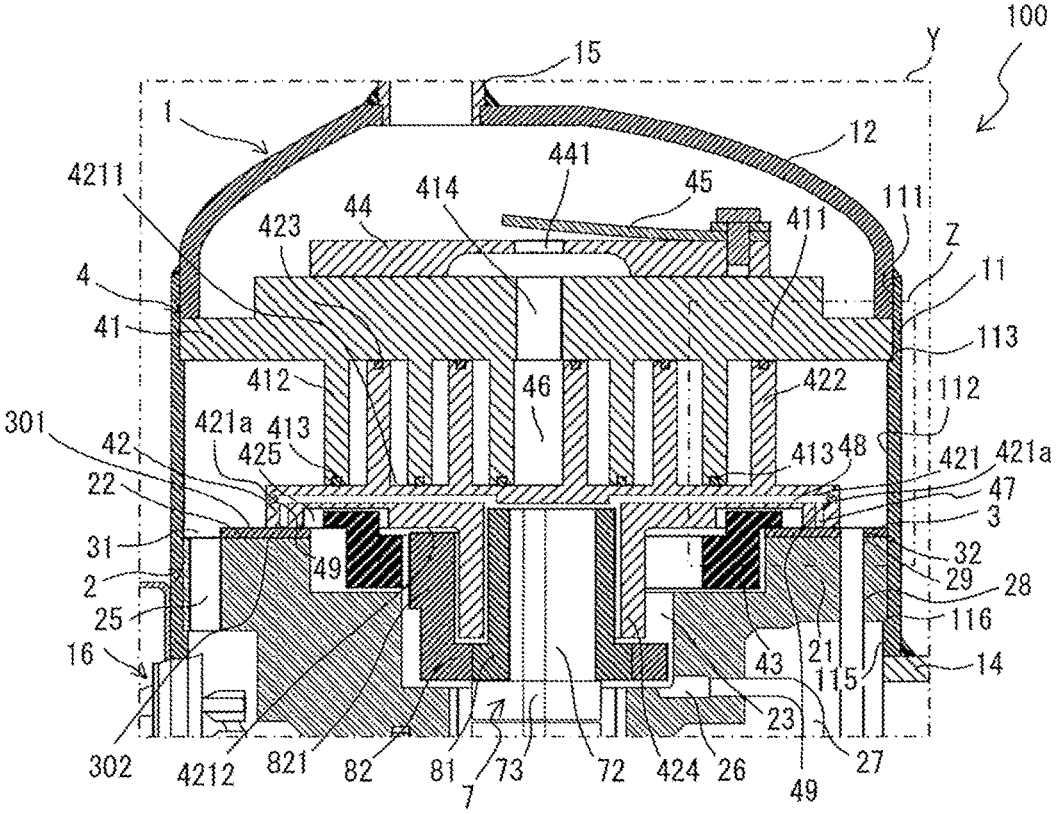
FIG. 5 is an enlarged detail of a region Y in the scroll compressor in FIG. 1.

FIG. 4 is a bottom view of the orbiting scroll 42 to be used in the scroll compressor 100 according to Embodiment 1 of the present disclosure. FIG. 5 is an enlarged detail of a region Y in the scroll compressor 100 in FIG. 1. The structure of the orbiting scroll 42 will be described in further detail with reference to FIG. 4 and FIG. 5. FIG. 4 is a diagram of the orbiting scroll 42 as viewed from the other end side L.

An oil supply groove 47 and oil supply passages 48 are formed on the second baseplate 421 of the orbiting scroll 42. The oil supply groove 47 is a circumferential groove formed at an outer circumferential region on the lower surface 4212 of the second baseplate 421. That is, the oil supply groove 47 is circularly formed along the circumferential direction of the second baseplate 421, at a wall portion facing the first surface portion 301. Through the oil supply groove 47, the lubricating oil supplied from the oil supply passage 48 is supplied to the first surface portion 301 of the thrust plate 3. The oil supply groove 47 is positioned above the thrust oil return pipes 29 and communicates with the thrust oil return pipes 29, only in a predetermined section while the crankshaft 7 rotates once.

The oil supply passages 48 are through-holes formed in the interior of the second baseplate 421. The oil supply passages 48 are formed so as to extend in the radial direction between the center of the second baseplate 421 formed in a disc shape and an outer edge portion. The oil supply passages 48 are formed along a nearly straight line on both sides of the second baseplate 421 across the crankshaft 7. One end of each oil supply passage 48 communicates with the interior of the tubular portion 424, and the other end of each oil supply passage 48 is an outlet portion 421*a* formed as an opening port on an outer lateral surface of the second baseplate 421. Further, in each oil supply passage 48, the flow passage on the outlet portion 421*a* side of the tubular portion 424 communicates with the oil supply groove 47. The cross-sectional shape of the oil supply passage 48 is a nearly perfect circle. The cross-sectional shape of the oil supply passage 48 is not limited to a perfect circle, and may be an ellipse, a flat circle, a polygon or other shapes. Each oil supply passage 48 is a lubricating oil flow passage through which the lubricating oil supplied from the crankshaft 7 flows from the inner side to the outer side in the radial direction. A seal member 49 is inserted into the outlet portion 421*a* of each oil supply passage 48. The two oil supply passages 48 are formed in the circumferential direction of the second baseplate 421. However, only one oil supply passage 48 may be formed, or three or more oil supply passages 48 may be formed when appropriate. Further, the oil supply passages 48 are formed along a nearly straight line on both sides across the crankshaft 7. However, the oil supply passages 48 are not limited to the configuration, and the oil supply passages 48 do not need to be formed along a nearly straight line on both sides across the crankshaft 7.

The seal members 49 are inserted from the lateral surface side of the second baseplate 421. For example, each seal member 49 is a metal screw made of a material having a linear expansion coefficient close to those of the fixed scroll 41 and the orbiting scroll 42. Each seal member 49 is not limited to the metal screw. For example, the seal member 49 may be a metal pin to be fixed by an adhesive agent or an elastic member such as a rubber to be fixed by press fitting, as long as the metal pin or the elastic member can be fixed while being inserted into the hole of the oil supply passage 48.

Referring again to FIG. 1 and FIG. 2, the Oldham ring 43 will be described. The Oldham ring 43 is a member for preventing the self-rotation of the orbiting scroll 42, and includes a ring portion 431, first key portions 432 and second key portions 433, as shown in FIG. 2. The ring portion 431 is circularly formed, and is disposed in the Oldham storage portion 231 of the main frame 2. The first key portions 432 are provided on a surface of the ring portion 431 on the other end side L. The first key portions 432 are configured as a pair, and are stored in the first Oldham grooves 233 of the main frame 2. The second key portions 433 are provided on a surface of the ring portion 431 on the one end side U. The second key portions 433 are configured as a pair, and are stored in the second Oldham grooves 425 of the orbiting scroll 42.

The scroll compressor 100 fits the second Oldham grooves 425 of the orbiting scroll 42 to the second key portions 433 of the Oldham rings 43, and thereby the position of the rotation direction of the second scroll body 422 of the orbiting scroll 42 is determined. That is, by the Oldham ring 43, the positioning of the orbiting scroll 42 relative to the main frame 2 is performed, and the phase of the second scroll body 422 relative to the main frame 2 is determined. Therefore, the Oldham ring 43 blocks the self-rotation motion of the orbiting scroll 42, and allows the orbiting motion of the orbiting scroll 42.

The chamber 44 is a plate-shaped member, and is provided on a surface of the fixed scroll 41 on the one end side U, to form a discharge hole 441 spatially communicating with the discharge port 414. The discharge valve 45 is a valve to open and close the discharge hole 441 depending on the pressure of the refrigerant, and is screwed to the chamber 44. When the pressure of the refrigerant in the compression chamber 46 communicating with the discharge port 414 reaches a predetermined pressure, the discharge valve 45 puts the discharge hole 441 into the open state.

The compression chamber 46 is formed by the engagement between the first scroll body 412 of the fixed scroll 41 and the second scroll body 422 of the orbiting scroll 42. More specifically, the compression chamber 46 is formed by the first baseplate 411 of the first scroll body 412 and the second baseplate 421 of the second scroll body 422. Further, the compression chamber 46 is formed to be sealed by the distal end of the first scroll body 412, the tip seal 413, the second baseplate 421, the distal end of the second scroll body 422, the tip seal 423 and the first baseplate 411.

The compression chamber 46 is constituted by a plurality of compression chambers having volumes that are reduced from the outer side to the inner side in the radial direction of the scroll. The refrigerant is suctioned in from a scroll body positioned at an outer end, and the orbital rotating of the orbiting scroll 42 is performed, so that the refrigerant is gradually compressed. The compression chamber 46 communicates with the discharge port 414 passing through a central portion of the first baseplate 411 of the fixed scroll 41, and the compressed refrigerant is ejected from the discharge port 414.

For example, as the refrigerant, a halogenated hydrocarbon having carbon double bond in the composition, a halogenated hydrocarbon having no carbon double bond, a natural refrigerant or a mixture containing them can be used. Examples of the halogenated hydrocarbon having carbon double bond include a HFO refrigerant such as R1234yf ($CF_3CF{=}CH_2$), R1234ze ($CF_3CH{=}CHF$) and R1233zd ($CF_3CH{=}CHCl$). Examples of the halogenated hydrocarbon having no carbon double bond include a HFC refrigerant such as R32 ($CH_2F_2$), R41 ($CH_3F$), R125 ($C_2HF_3$), R134a ($CH_2FCF_2$), R143a ($CF_3CH_3$), R410A (R32/R125) and R407C (R32/R125/R134a). Examples of the mixture include a refrigerant in which R32 (difluoromethane) expressed as $CH_2F_2$, R 41 and other halogenated hydrocarbons are mixed. Examples of the natural refrigerant include ammonia ($NH_3$), carbon dioxide ($CO_2$), propane ($C_3H_8$), propylene ($C_3H_6$), butane ($C_4H_{10}$) and isobutane ($CH(CH_3)_3$).

(Thrust Oil Return Pipe 29)

The thrust oil return pipes 29 are inserted into the thrust oil return holes 28 formed on the main frame 2, and are fixed to the main frame 2. The lubricating oil supplied to the lubricated portion of the scroll compressor 100 flows to return to the oil reservoir 131 through the thrust oil return pipes 29. The thrust oil return pipes 29 are disposed to pass through the body portion 21 of the main frame 2 in the vertical direction. That is, the thrust oil return pipes 29 are provided to extend in the top-bottom direction of the shell 1, and are provided along the extending direction of the crankshaft 7.

The thrust oil return pipes 29 are inserted into the hole portions 32 of the thrust plate 3, and are fit in the thrust plate 3. The number of the thrust oil return pipes 29 may be one, but preferably, a plurality of thrust oil return pipes 29 should be provided. In the case where the scroll compressor 100 includes a plurality of thrust oil return pipes 29, the plurality of thrust oil return pipes 29 are inserted into a plurality of hole portions 32 formed on the thrust plate 3, and are fit in the thrust plate 3. The position of the thrust plate 3 relative to the main frame 2 is determined by the plurality of thrust oil return pipes 29.

(Drive Mechanism Unit 5)

The drive mechanism unit 5 generates rotation motion for rotating the crankshaft 7, in the interior of the shell 1. The drive mechanism unit 5 is provided on the other end side L of the main frame 2. The drive mechanism unit 5 includes the stator 51 and a rotor 52.

For example, the stator 51 is a stator in which a winding wire is wound around an insulating layer on an iron core formed by a plurality of laminated magnetic steel sheets, and is formed in a ring shape. The stator 51 is fixed to the inner wall of the main shell 11 by shrink fitting or other methods. The stator 51 rotates the rotor 52, using electric power supplied from the exterior of the scroll compressor 100. The rotor 52 is a cylindrical rotor containing a permanent magnet in the interior of an iron core formed by a plurality of laminated magnetic steel sheets and having a through-hole passing in the vertical direction at the center, and is disposed in the internal space of the stator 51. The crankshaft 7 to transmit the rotation drive force of the drive mechanism unit 5 to the orbiting scroll 42 is fixed to the rotor 52. When the electric power is supplied to the stator 51, the rotor 52 rotates, and thereby rotates integrally with the crankshaft 7.

(Sub Frame 6)

The sub frame 6 is one of the frames of the scroll compressor 100. The sub frame 6 is a frame made of metal. The sub frame 6 is provided on the other end side L of the drive mechanism unit 5, and is fixed to the inner circumferential wall of the main shell 11 by shrink fitting, welding or other methods. The sub frame 6 supports the crankshaft 7 across a sub bearing portion 61 in a rotatable manner. The sub frame 6 includes the sub bearing portion 61 and an oil pump 62.

The sub bearing portion 61 is a ball bearing provided on the upper side of the center of the sub frame 6. The sub bearing portion 61 is not limited to the ball bearing, and may be another kind of bearing. The oil pump 62 is a pump to suck up the lubricating oil reserved in the oil reservoir 131 of the shell 1, and is provided on the lower side of the center of the sub frame 6. The oil pump 62 supplies the lubricating oil sucked up from the oil reservoir 131 of the shell 1, to the lubricated portion such as the bearing portion in the scroll compressor 100, and the lubricating oil lubricates the lubricated portion.

The lubricating oil is reserved in a lower portion of the shell 1, that is, in the lower shell 13. The lubricating oil is sucked up by the oil pump 62, and is supplied to the compression mechanism unit 4 and other parts through an oil passage 73 in the crankshaft 7 described later. The lubricating oil reduces the abrasion between parts mechanically contacting with each other in the compression mechanism unit 4 and other parts, regulates the temperatures of sliding portions, and improves sealing property and other properties. As the lubricating oil, it is preferable to use an oil having a good lubricative property, electric insulation, stability, refrigerant solubility and low temperature fluidity, and having a moderate viscosity. For example, in the scroll compressor 100, it is possible to use an oil composed of naphthene series, polyol ester (POE), polyvinyl ether (PVE), or polyalkylene glycol (PAG).

(Crankshaft 7)

The crankshaft 7 couples the drive mechanism unit 5 and the orbiting scroll 42 of the compression mechanism unit 4, and transmits the rotation motion of the drive mechanism unit 5 to the orbiting scroll 42. The crankshaft 7 is a rod-shaped member made of metal, and is provided in the interior of the shell 1. The crankshaft 7 includes a main shaft portion 71 and an eccentric shaft portion 72. In the crankshaft 7, the oil passage 73 is formed in the interior of the main shaft portion 71 and the eccentric shaft portion 72.

The main shaft portion 71 is a shaft forming a principal portion of the crankshaft 7, and is disposed such that the central axis of the main shaft portion 71 coincides with the central axis of the main shell 11. The main shaft portion 71 is fixed to the through-hole at the center of the rotor 52 by shrink fitting or other methods. The eccentric shaft portion 72 is provided on the one end side U of the main shaft portion 71, such that the central axis of the eccentric shaft portion 72 deviates from the central axis of the main shaft portion 71. The oil passage 73 is vertically formed along the axis direction in the interior of the main shaft portion 71 and the eccentric shaft portion 72. The lubricating oil sucked up from the oil reservoir 131 by the oil pump 62 flows through the oil passage 73.

The crankshaft 7 is inserted into the shaft hole 24 of the main frame 2, and the other end side L of the crankshaft 7 is inserted into the through-hole of the sub bearing portion 61 of the sub frame 6, so that the crankshaft 7 is supported by the main frame 2 and the sub frame 6 in a rotatable manner. Thereby, the eccentric shaft portion 72 positioned at an upper portion of the crankshaft 7 is disposed in the tube of the tubular portion 424. The rotor 52 fixed to the crankshaft 7 is disposed with the stator 51, and is disposed such that there is a predetermined clearance between an outer circumferential surface of the rotor 52 and an inner circumferential surface of the stator 51.

(Bush 8)

The bush 8 is made of a metal such as iron, and is a connection member connecting the orbiting scroll 42 and the crankshaft 7. As shown in FIG. 2, the bush 8 includes the slider 81 and a balance weight 82.

The slider 81 is a tubular member on which a collar is formed, and is fit into the tubular portion 424 in a state where the eccentric shaft portion 72 is inserted into the slider 81. The balance weight 82 is a toroidal member including a weight portion 821 in which the shape as viewed from the one end side U is a nearly C-shape, and is provided to be eccentric relative to the rotation center for offsetting the centrifugal force of the orbiting scroll 42. For example, the balance weight 82 is fit in the collar of the slider 81 by shrink fitting or other methods.

[Relation Between Shell 1 and Compression Mechanism Unit 4]

The relation between the shell 1 and the compression mechanism unit 4 will be described in further detail with reference to FIG. 2 and FIG. 5.

As shown in a region Z in FIG. 5, the fixed scroll 41 is fixed to a first inner wall surface portion 111 of the main shell 11 that is the inner wall of the shell 1. More specifically, as shown in FIG. 2, the main shell 11 includes the first inner wall surface portion 111 on the one end side U and includes a second inner wall surface portion 112 on the other end side L. The second inner wall surface portion 112 is a portion of the inner wall of the main shell 11 where the inner diameter is smaller compared to the first inner wall surface portion 111. That is, the second inner wall surface portion 112 is formed to protrude from the first inner wall surface portion 111 in the direction of the center of the main shell 11. Therefore, a first positioning portion 113 formed in a stepped shape is included between the second inner wall surface portion 112 and the first inner wall surface portion 111.

The first positioning portion 113 is formed on the second inner wall surface portion 112 such that the first positioning portion 113 is oriented toward the one end side U, and performs the positioning of the fixed scroll 41. The fixed scroll 41 is fixed to the first inner wall surface portion 111 by shrink fitting, welding or other methods, in a state where the positioning is performed by the first positioning portion 113. That is, the main shell 11 includes a step portion whose inner diameter decreases from the one end side U to the other end side L, and the positioning and fixation of the fixed scroll 41 are performed by using the step.

The main shell 11 further includes a third inner wall surface portion 115. The third inner wall surface portion 115 is a portion of the inner wall of the main shell 11 where the inner diameter is smaller compared to the second inner wall surface portion 112. The third inner wall surface portion 115 is formed to protrude from the second inner wall surface portion 112 in the direction of the center of the main shell 11. Therefore, a second positioning portion 116 formed in a stepped shape is included between the third inner wall surface portion 115 and the second inner wall surface portion 112.

The second positioning portion 116 is formed on the third inner wall surface portion 115 such that the second positioning portion 116 is oriented toward the one end side U, and performs the positioning of the main frame 2. The main frame 2 is fixed to the second inner wall surface portion 112 by shrink fitting or other methods, in a state where the positioning is performed by the second positioning portion 116. That is, the main shell 11 includes a step portion whose inner diameter decreases from the one end side U to the other end side L, and the positioning and fixation of the main frame 2 are performed by using the step.

In this way, in the scroll compressor 100, the fixed scroll 41 is fixed to the inner wall surface of the main shell 11, so that a frame outer wall-less structure can be realized. In a scroll compressor in the related art, the fixed scroll 41 is screwed to the main frame 2, and therefore, generally, the main frame 2 includes an outer wall on which the fixed scroll 41 is placed along the outer edge portion on the one end side U. However, when the main frame 2 includes the outer wall, the orbiting scroll 42 is disposed in the space within the outer wall, and the size of the orbiting scroll 42 is limited by the outer wall of the main frame 2. Therefore, in the scroll compressor in the related art, due to the limitation of the size of the orbiting scroll 42, the scroll capacity is limited, so that it is not possible to enhance the utmost performance of the compressor.

On the other hand, the frame outer wall-less structure of the scroll compressor 100 does not include the outer wall for the screwing between the main frame 2 and the fixed scroll 41. Therefore, in the scroll compressor 100, a space is formed between the lateral surface of the second baseplate 421 of the orbiting scroll 42 and the inner wall surface of the main shell 11. In other words, the scroll compressor 100 has a radial space in the interior of the main shell 11 in which the orbiting scroll 42 is disposed. Therefore, it is possible to increase the outer diameter of the second baseplate 421 and the scroll diameter of the second scroll body 422, compared to the related art. That is, in the scroll compressor 100, it is possible to enhance the utmost performance of the compressor, by increasing the diameter of the first scroll body 412 and the diameter of the second scroll body 422 while the shell 1 is designed similarly to the related art. Further, in the scroll compressor 100, it is possible to reduce the surface pressure of thrust load, by increasing the size of the second baseplate 421 while the shell 1 is designed similarly to the related art. Moreover, it is possible to downsize the compressor without decreasing the utmost performance, by reducing the diameter of the main shell 11 while the size of the orbiting scroll 42 is not changed.

[Relation Between Thrust Plate 3 and Thrust Oil Return Pipe 29]

Figure 6:
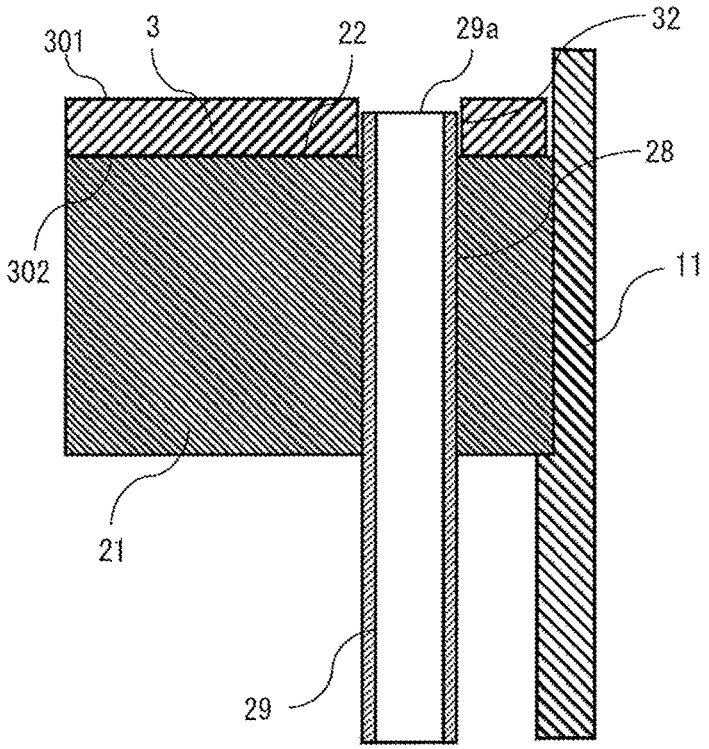
FIG. 6 is an explanatory diagram of the positional relation between the thrust plate and a thrust oil return pipe in the scroll compressor in FIG. 5.

FIG. 6 is an explanatory diagram of the positional relation between the thrust plate 3 and the thrust oil return pipe 29 in the scroll compressor 100 in FIG. 5. The positional relation of the thrust plate 3, the thrust oil return pipes 29 and the main shell 11 will be described with reference to FIG. 2 to FIG. 6.

Each thrust oil return pipe 29 is inserted into the thrust oil return hole 28 formed on the body portion 21 of the main frame 2, and is fixed at such a position that the upper end portion 29*a* of the thrust oil return pipe 29 protrudes from the flat surface 22 by a predetermined length. Here, two or more thrust oil return pipes 29 are inserted and fixed to the main frame 2. The thrust plate 3 is disposed on the flat surface 22 such that the thrust oil return pipes 29 protruding from the flat surface 22 are fit in the hole portions 32 of the thrust plate 3.

For the outer diameter of the thrust oil return pipe 29 and the inner diameter of the hole portion 32, the fitting of the thrust oil return pipes 29 and the thrust plate 3 is performed in a state where a predetermined clearance is formed such that the thrust plate 3 does not contact with the second inner wall surface 114 of the main shell 11. Therefore, the positioning of the thrust plate 3 is performed only by the fitting of the thrust oil return pipes 29 and the hole portions 32 of the thrust plate 3. Further, the protrusion length of the thrust oil return pipes 29 from the flat surface 22 is shorter than the thickness of the thrust plate 3, so that the upper end portions 29*a* of the thrust oil return pipes 29 do not protrude from the first surface portion 301 of the thrust plate 3.

[Description about Action of Scroll Compressor 100]

Next, the action of the scroll compressor 100 will be described. When the electric power is supplied to the stator 51 from the exterior of the scroll compressor 100, a magnetic field is generated in the stator 51. The magnetic field acts to rotate the rotor 52. That is, when the electric power is supplied to the stator 51, the rotor 52 generates torque, and rotates the crankshaft 7 supported by the main frame 2 and the sub frame 6. The orbiting scroll 42 connected to the crankshaft 7 performs the orbiting motion while the self-rotation of the orbiting scroll 42 is restricted by the Oldham ring 43 reciprocating in the direction of the first Oldham grooves 233 of the main frame 2. By these actions, the scroll compressor 100 changes the volume of the compression chamber 46 formed by the combination of the first scroll body 412 of the fixed scroll 41 and the second scroll body 422 of the orbiting scroll 42.

Due to the orbiting motion of the orbiting scroll 42, the gas-state refrigerant suctioned from the suction pipe 14 into the shell 1 is introduced into the compression chamber 46 formed between the first scroll body 412 of the fixed scroll 41 and the second scroll body 422 of the orbiting scroll 42, and is compressed while flowing to the center. Then, the compressed refrigerant passes through the discharge port 414 formed on the first baseplate 411 of the fixed scroll 41. Furthermore, the refrigerant is discharged from the discharge hole 441 formed on the chamber 44, after opening the discharge valve 45. Then, the refrigerant is ejected from the discharge pipe 15 to the refrigerant circuit in the exterior of the scroll compressor 100.

[Supply of Oil to Orbiting Scroll 42]

Next, the supply of the lubricating oil to the thrust surface of the orbiting scroll 42 will be described with reference to FIG. 2 and FIG. 3. The lubricating oil is reserved in the lower portion of the shell 1, that is, in the lower shell 13. As described above, the lubricating oil is sucked up by the oil pump 62, and is supplied to the compression mechanism unit 4 and other parts through the oil passage 73 in the crankshaft 7.

Some of the lubricating oil reaching the upper end of the crankshaft 7 through the oil passage 73 in the crankshaft 7 is supplied to the oil supply groove 47 on the thrust surface of the orbiting scroll 42 through the oil supply passages 48 of the orbiting scroll 42. Here, the oil supply groove 47 is positioned to overlap with the hole portions 32 of the thrust plate 3, that is, the opening ports of the thrust oil return pipes 29, only in the predetermined section while the compressor rotates once. The lubricating oil lubricates the thrust surface of the orbiting scroll 42, and then is returned to the lower portion of the shell 1, that is, the lower shell 13, through the thrust oil return pipes 29. Here, the outlet portions 421*a* of the oil supply passages 48 on the second baseplate 421 side are sealed by seal members 49, such that the lubricating oil passing through the oil supply passages 48 is supplied to the oil supply groove 47.

[Production Method for Scroll Compressor 100]

A production method for the scroll compressor 100 according to Embodiment 1 of the present disclosure, particularly, the disposition of the fixed scroll 41, will be described with reference to FIG. 1 to FIG. 5.

A worker inserts the main frame 2 into the main shell 11 from the one end side U of the main shell 11. On this occasion, the surface of the main frame 2 comes in contact with the second positioning portion 116 of the third inner wall surface portion 115, and the positioning of the main frame 2 in the height direction of the main shell 11 is performed. In this state, the worker fixes the main frame 2 to the second inner wall surface portion 112 by shrink fitting, arc spot welding or other methods. Then, the worker inserts the crankshaft 7 into the shaft hole 24 of the main frame 2. Thereafter, the worker attaches the bush 8 to the eccentric shaft portion 72, and disposes the Oldham ring 43, the orbiting scroll 42 and other parts.

Next, the worker inserts the fixed scroll 41 into the main shell 11 from the one end side U of the main shell 11. On this occasion, the surface of the fixed scroll 41 comes in contact with the first positioning portion 113 of the second inner wall surface portion 112, and the positioning of the fixed scroll 41 in the height direction of the main shell 11 is performed.

In Embodiment 1, there is no member such as a screw for the positioning of the fixed scroll 41 in the circumferential direction, unlike the related art. Therefore, in the scroll compressor 100, the fixed scroll 41 can rotate relative to the orbiting scroll 42 until the fixed scroll 41 is fixed to the first inner wall surface portion 111. As a result, in the scroll compressor 100, there is a possibility of change in the positional relation between the first scroll body 412 and the second scroll body 422. Hence, in the scroll compressor 100, the phase is adjusted by rotating the fixed scroll 41 such that the positional relation of the first scroll body 412 relative to the second scroll body 422 of the orbiting scroll 42 becomes a predetermined positional relation. Thereafter, in the scroll compressor 100, the fixed scroll 41 is fixed to the first inner wall surface portion 111 by shrink fitting, arc spot welding and other methods.

Scroll Compressor 200 in Comparative Example

Figure 7:
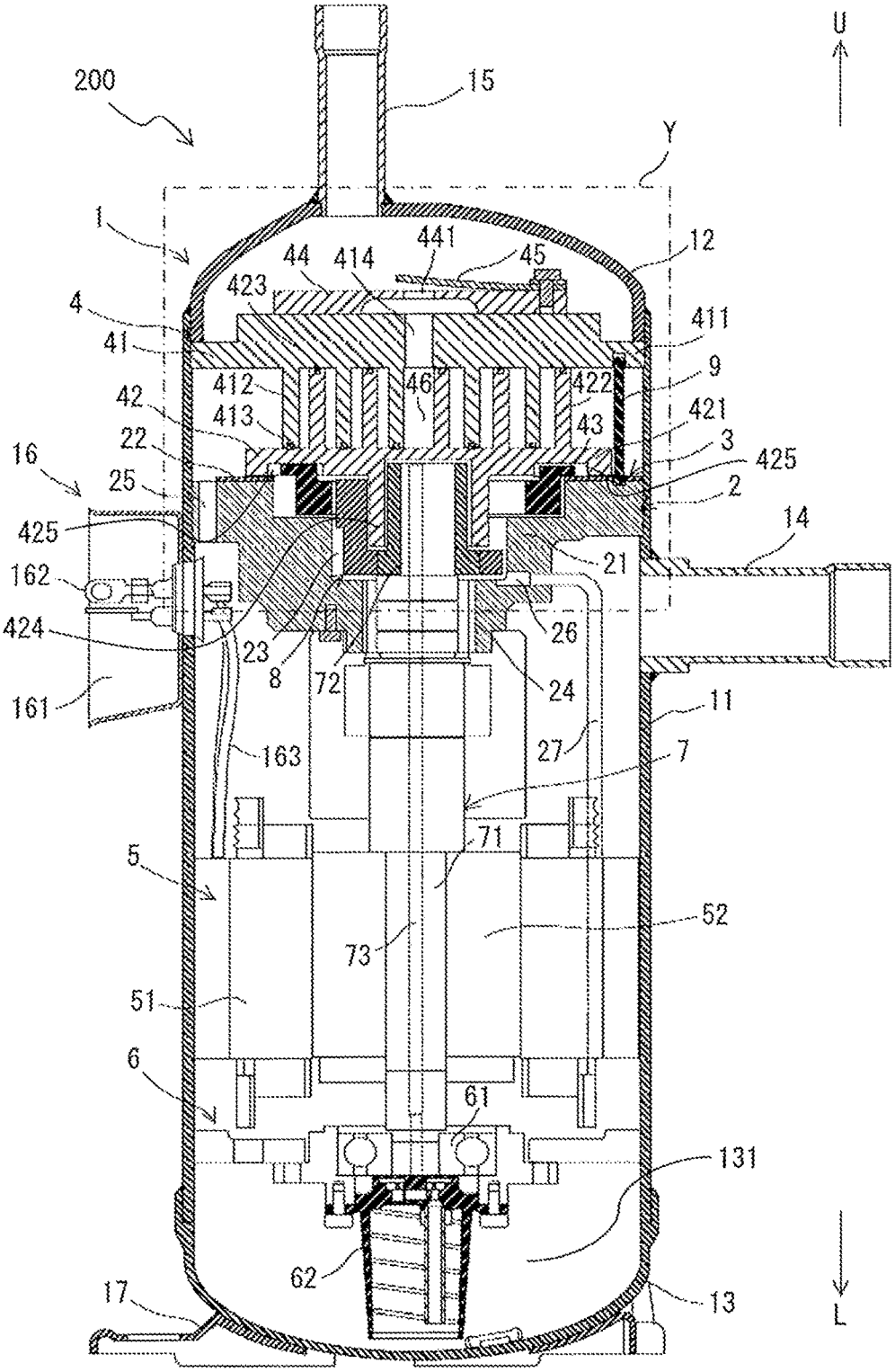
FIG. 7 is a longitudinal sectional view of a scroll compressor according to a comparative example.
Figure 8:
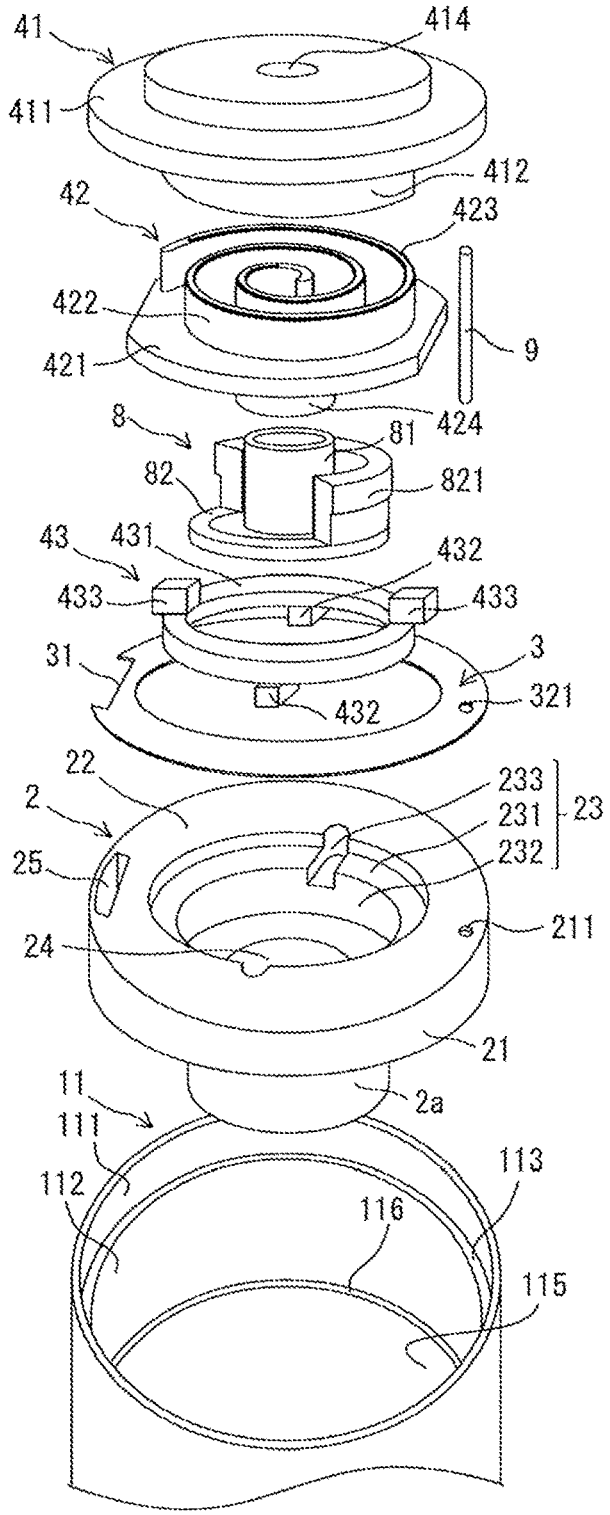
FIG. 8 is an exploded perspective view of a partial configuration of the scroll compressor according to the comparative example.

FIG. 7 is a longitudinal sectional view of a scroll compressor 200 according to a comparative example. FIG. 8 is an exploded perspective view of a partial configuration of the scroll compressor 200 according to the comparative example. Parts having functions identical to those of the scroll compressor 100 in FIG. 1 to FIG. 6 are denoted by identical reference characters, and descriptions therefor are omitted. The scroll compressor 200 according to the comparative example has what is called the frame outer wall-less structure, and is similar to the scroll compressor in Patent Literature 1 in that the fixed scroll 41 and the main frame 2 are coupled by a positioning pin 9. In the scroll compressor 200 according to the comparative example, a lower end portion of the positioning pin 9 is inserted into a concave portion 211 formed on the main frame 2, and an upper end portion of the positioning pin 9 is attached to the fixed scroll 41, so that the fixed scroll 41 and the main frame 2 are coupled.

In the scroll compressor 200 according to the comparative example, the thrust load generated at the time of the compression of the refrigerant is supported by the main frame 2 through the orbiting scroll 42. In the case of what is called the frame outer wall-less structure such as the structure of the scroll compressor 200 according to the comparative example, there is a possibility that the outer edge of the thrust plate 3 intermittently comes in contact with the inner wall of the shell 1 during the operation of the compressor and thereby noise and vibration increase. Further, in the scroll compressor 200 according to the comparative example, the self-rotation of the thrust plate 3 can be prevented by the positioning pin 9 coupling the fixed scroll 41 and the main frame 2. For example, in the scroll compressor 200 according to the comparative example, the positioning pin 9 is inserted into a hole portion 321 formed on the thrust plate 3, and thereby the self-rotation of the thrust plate 3 can be prevented. However, in the scroll compressor 200 according to the comparative example, it is necessary to avoid the interference between the positioning pin 9 coupling the fixed scroll 41 and the main frame 2 and the orbiting scroll 42, and it is not possible to adopt a large-size orbiting scroll 42. Therefore, in the scroll compressor 200 according to the comparative example, the scroll capacity to determine the utmost performance of the compressor is limited.

[Function and Effect of Scroll Compressor 100]

According to the scroll compressor 100, the thrust oil return pipes 29 are inserted into the hole portions 32 and are fit in the thrust plate 3, and the upper end portions 29*a* of the thrust oil return pipes 29 do not protrude from the first surface portion 301 of the thrust plate 3. Therefore, the scroll compressor 100 makes it possible to prevent the self-rotation of the thrust plate 3, even when there is no positioning pin 9 coupling the fixed scroll 41 and the main frame 2. Further, since there is no positioning pin 9 coupling the fixed scroll 41 and the main frame 2, the scroll compressor 100 makes it possible to adopt a large-size orbiting scroll 42, and to enhance the utmost performance of the compressor. Furthermore, the scroll compressor 100 makes it possible to prevent the self-rotation of the thrust plate 3, to avoid the contact between the outer edge of the thrust plate 3 and the inner wall of the main shell 11, and to reduce the noise and vibration of the compressor.

Further, the position of the thrust plate 3 relative to the main frame 2 is determined by the plurality of thrust oil return pipes 29. Therefore, the scroll compressor 100 makes it possible to prevent the self-rotation of the thrust plate 3, to adopt a large-size orbiting scroll 42, and to enhance the utmost performance of the compressor, even when there is no positioning pin 9 coupling the fixed scroll 41 and the main frame 2. Further, the scroll compressor 100 makes it possible to prevent the self-rotation of the thrust plate 3, to avoid the contact between the outer edge of the thrust plate 3 and the inner wall of the main shell 11, and to reduce the noise and vibration of the compressor.

Further, the fixed scroll 41 faces the orbiting scroll 42, and faces the main frame 2 across the thrust plate 3, and the fixed scroll 41 and the main frame 2 are fixed to the shell 1. The scroll compressor 100 has what is called the frame outer wall-less structure in which the clearance is formed between the fixed scroll 41 and the main frame 2, and the thrust load generated at the time of the compression of the refrigerant is supported by the main frame 2 through the orbiting scroll 42. Even when the scroll compressor 100 has what is called the frame outer wall-less structure, the scroll compressor 100 makes it possible to prevent the self-rotation of the thrust plate 3 without using the positioning pin 9 coupling the fixed scroll 41 and the main frame 2. Therefore, the scroll compressor 100 makes it possible to adopt a large-size orbiting scroll 42, and to enhance the utmost performance of the compressor, and makes it possible to avoid the contact between the outer edge of the thrust plate 3 and the inner wall of the main shell 11, and to reduce the noise and vibration of the compressor. That is, even when the scroll compressor 100 has what is called the frame outer wall-less structure, the scroll compressor 100 makes it possible to enhance the utmost performance of the compressor, and to provide a low-noise, low-vibration, high-performance and high-reliability compressor.

Further, in the scroll compressor 100, the thrust load increases due to the enhancement of the utmost performance of the compressor that is caused by the increase in the size of the orbiting scroll 42. However, the oil supply groove 47 of the orbiting scroll 42 is circularly formed along the circumferential direction of the second baseplate 421, at the wall portion of the second baseplate 421 facing the first surface portion 301 and forming the thrust surface. Furthermore, the oil supply groove 47 is positioned to face the upper end portions of the thrust oil return pipes 29 and communicates with the thrust oil return pipes 29, only in the predetermined section while the crankshaft 7 rotates once. Therefore, by adjusting the supply amount of the thrust lubricating oil, the scroll compressor 100 makes it possible to improve thrust slide property, to reduce thrust slide loss, and to secure thrust reliability.

Further, the seal members 49 are inserted into the outer circumferential ends of the oil supply passages 48. By using the seal members 49, the scroll compressor 100 makes it possible to seal the outer ends of the oil supply passages 48. Therefore, the scroll compressor 100 makes it possible to easily form the oil supply passages 48 extending in the radial direction of the second baseplate 421.

Embodiment 2

Figure 9:
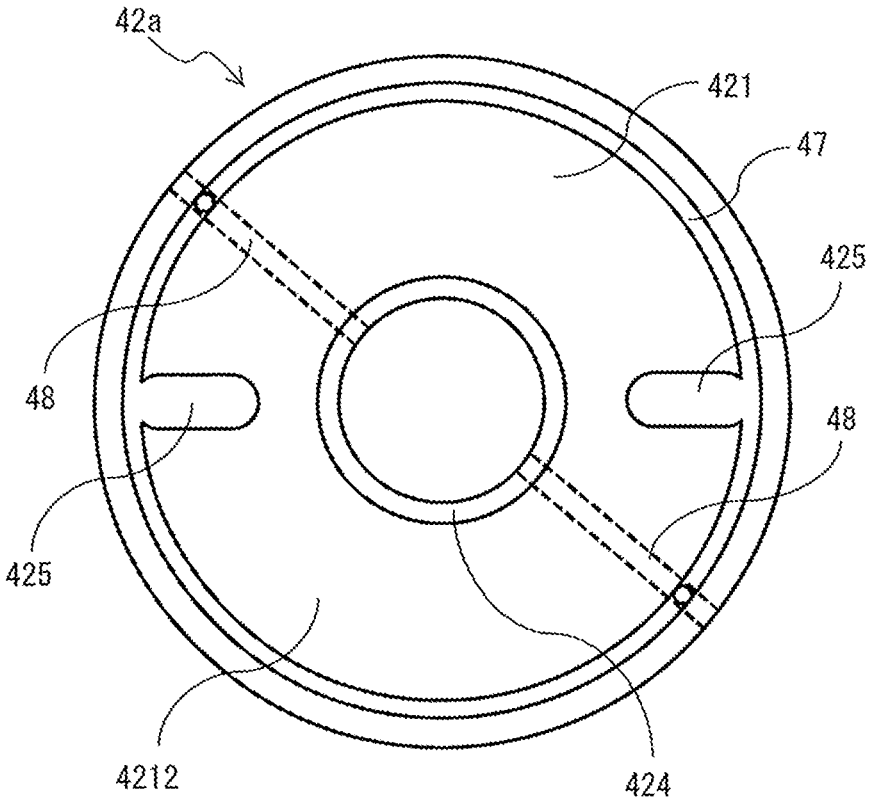
FIG. 9 is a bottom view of an orbiting scroll to be used in a scroll compressor according to Embodiment 2 of the present disclosure.

FIG. 9 is a bottom view of an orbiting scroll 42*a* to be used in a scroll compressor 100 according to Embodiment 2 of the present disclosure. Parts having configurations identical to those of the scroll compressor 100 in FIG. 1 to FIG. 6 are denoted by identical reference characters, and descriptions therefor are omitted. Further, items that are particularly not mentioned about the orbiting scroll 42*a* are the same as those about the orbiting scroll 42 of the scroll compressor 100 according to Embodiment 1 of the present disclosure, and identical functions and identical configurations will be described with use of identical reference characters.

The orbiting scroll 42*a* is different from the orbiting scroll 42 of the scroll compressor 100 according to Embodiment 1, in that the oil supply groove 47 communicates with the second Oldham grooves 425. That is, the second Oldham grooves 425 are formed to communicate with the oil supply groove 47. Therefore, in the scroll compressor 100, the lubricating oil supplied from the oil supply passages 48 to the oil supply groove 47 is easily supplied from the oil supply groove 47 to the second Oldham grooves 425.

In the scroll compressor 100 using the orbiting scroll 42*a*, the property of the slide between the second Oldham grooves 425 and the second key portions 433 of the Oldham ring 43 is improved, in addition to the effects of the scroll compressor 100 according to Embodiment 1.

Embodiment 3

Figure 10:
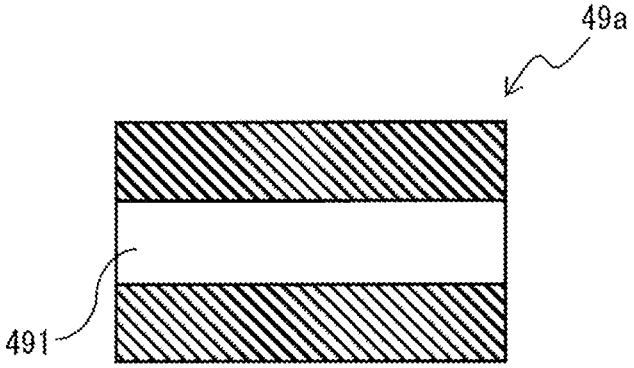
FIG. 10 is a longitudinal sectional view of a seal member to be used in a scroll compressor according to Embodiment 3 of the present disclosure.

FIG. 10 is a longitudinal sectional view of a seal member 49*a* to be used in a scroll compressor 100 according to Embodiment 3 of the present disclosure. Parts having configurations identical to those of the scroll compressor 100 in FIG. 1 to FIG. 6 and FIG. 9 are denoted by identical reference characters, and descriptions therefor are omitted. Further, items that are particularly not mentioned about the seal member 49*a* are the same as those about the seal member 49 of the scroll compressor 100 according to Embodiment 1 of the present disclosure, and identical functions and identical configurations will be described with use of identical reference characters.

The seal member 49*a* is different from the seal member 49 of the scroll compressor 100 according to Embodiment 1, in that a through-hole 491 is formed in the seal member 49*a*. The number of through-holes 491 to be formed in the seal member 49*a* may be one, or may be two or more. The through-hole 491 is formed in the radial direction of the second baseplate 421, in a state where the seal member 49*a* is inserted into the end portion of the oil supply passage 48. The through-hole 491 communicates with the oil supply passage 48.

Some of the lubricating oil flowing through the oil supply passage 48 flows in the direction of the oil supply groove 47, and some of the lubricating oil flows in the direction of the seal member 49*a*. The lubricating oil flowing in the direction of the oil supply groove 47 lubricates the lower surface 4212 of the second baseplate 421 and the thrust plate 3. The lubricating oil flowing in the direction of the seal member 49 is discharged from the lateral surface of the second baseplate 421 after the flow volume is regulated by the through-hole 491.

In the scroll compressor 100 using the seal member 49*a*, the lubricating oil is supplied to the compression chamber 46 through the through-holes 491 of the seal members 49*a*, and therefore the slide property of the scroll body is improved, in addition to the effects of the scroll compressor 100 according to Embodiment 1.

The embodiments of the present disclosure are not limited to Embodiments 1 to 3, and various modifications can be made. For example, in the scroll compressor 100 according to Embodiment 1, the oil supply groove 47 has a circular ring shape and the number of oil supply grooves 47 is one. However, the shape of the oil supply groove 47 and the number of oil supply grooves 47 do not matter as long as the intended effect can be obtained. Further, the scroll compressor 100 according to Embodiment 1 is a compressor having what is called the frame outer wall-less structure. However, the scroll compressor 100 may be a compressor including a frame outer wall on which the fixed scroll 41 is placed, at the outer circumferential portion of the main frame 2.

REFERENCE SIGNS LIST

1: shell, 2: main frame, 2*a*: main bearing portion, 3: thrust plate, 4: compression mechanism unit, 5: drive mechanism unit, 6: sub frame, 7: crankshaft, 8: bush. 9: positioning pin, 11: main shell, 12: upper shell, 13: lower shell, 14: suction pipe, 15: discharge pipe, 16: electric supply unit, 17: fixed base, 21: body portion, 22: flat surface, 23: storage portion, 24: shaft hole, 25: suction port, 26: oil return hole, 27: oi return pipe, 28: thrust oil return hole, 29: thrust oil return pipe, 29*a*: upper end portion, 31: cutout portion, 32: hole portion, 41: fixed scroll, 42: orbiting scroll, 42*a*: orbiting scroll, 43: Oldham ring, 44: chamber, 45: discharge valve, 46: compression chamber, 47: oil supply groove, 48: oil supply passage, 49: seal member, 49*a*: seal member, 51: stator, 52: rotor, 61: sub bearing portion, 62: oil pump, 71: main shaft portion, 72: eccentric shaft portion, 73: oil passage, 81: slider, 82: balance weight, 100: scroll compressor, 111: first inner wall surface portion, 112: second inner wall surface portion, 113: first positioning portion, 114: second inner wall surface, 115: third inner wall surface portion, 116: second positioning portion, 131: oil reservoir, 161: cover, 162: electric supply terminal, 163: wire, 200: scroll compressor, 211: concave portion, 231: Oldham storage portion, 232: bush storage portion, 233: first Oldham groove, 301: first surface portion, 302: second surface portion, 321: hole portion, 411: first baseplate, 412: first scroll body, 413: tip seal, 414: discharge port, 421: second baseplate, 421*a*: outlet portion, 422: second scroll body, 423: tip seal, 424: tubular portion, 425: second Oldham groove, 431: ring portion, 432: first key portion, 433: second key portion, 441: discharge hole, 491: through-hole, 821: weight portion, 4211: upper surface, 4212: lower surface

The invention claimed is:

1. A scroll compressor comprising:

a shell forming an outer case, the shell forming an oil reservoir in which lubricating oil is reserved;

a fixed scroll stored in the shell;

an orbiting scroll stored in the shell, the orbiting scroll forming a compression chamber together with the fixed scroll;

a frame holding the orbiting scroll;

a thrust plate disposed between the orbiting scroll and the frame; and a thrust oil return pipe fixed to the frame, the thrust oil return pipe being a pipe through which the lubricating oil flows to return to the oil reservoir, wherein:

a hole portion is formed on the thrust plate, the hole portion passing from a first surface portion of the thrust plate to a second surface portion of the thrust plate, the first surface portion slidably contacting with the orbiting scroll, the second surface portion facing the frame; and the thrust oil return pipe is inserted into the hole portion and is fit in the thrust plate, and an upper end portion of the thrust oil return pipe does not protrude from the first surface portion of the thrust plate, further comprising a crankshaft in which an oil passage is formed, the oil passage being a passage through which the lubricating oil sucked up from the oil reservoir flows, wherein: the orbiting scroll includes a baseplate formed in a disc shape, one surface of the baseplate having a scroll body formed thereon, an other surface of the baseplate facing the first surface portion;

an oil supply passage and an oil supply groove are formed on the baseplate, the oil supply passage being a passage through which the lubricating oil supplied from the crankshaft flows 3 from an inner side to an outer side in a radial direction, the oil supply groove being a groove through which the lubricating oil supplied from the oil supply passage is supplied to the first surface portion; and the oil supply groove is circularly formed along a circumferential direction of the baseplate, at a wall portion of the baseplate that faces the first surface portion, and is positioned to face the upper end portion of the thrust oil return pipe and communicates with the thrust oil return pipe, only in a predetermined section while the crankshaft rotates once.

2. The scroll compressor of claim 1, wherein:

a plurality of the hole portions are formed on the thrust plate;

a plurality of the thrust oil return pipes are fixed to the frame;

the plurality of the thrust oil return pipes are inserted into the plurality of the hole portions and are fit in the thrust plate; and a position of the thrust plate relative to the frame is determined by the plurality of the thrust oil return pipes.

3. The scroll compressor of claim 1, wherein:

the fixed scroll faces the orbiting scroll and faces the frame across the thrust plate; and the fixed scroll and the frame are fixed to the shell.

4. The scroll compressor of claim 1, wherein:

the oil supply passage passes to an outer lateral surface of the baseplate; and a seal member is inserted into an outer circumferential end of the oil supply passage.

5. The scroll compressor of claim 4, wherein one or more through-holes are formed in the seal member.

6. The scroll compressor of claim 1, wherein:

an Oldham groove of the orbiting scroll is formed on the baseplate, the Oldham groove being a groove in which a part of an Oldham ring is stored; and the Oldham groove is formed to communicate with the oil supply groove.

* * * * *